US005154227A

United States Patent [19]

Csaba et al.

[11] Patent Number: 5,154,227

[45] Date of Patent: Oct. 13, 1992

[54] JET CONDENSER

[75] Inventors: Gábor Csaba; János Bódás; György Bergmann; György Frank; György Pálfalvi, all of Budapest, Hungary

[73] Assignee: Energiagazdalkodasi Intezet, Budapest, Hungary

[21] Appl. No.: 728,578

[22] Filed: Jul. 11, 1991

[30] Foreign Application Priority Data

Jul. 18, 1990 [HU] Hungary ..... 4531/90

[51] Int. Cl.[5] ..... F28B 3/04; F28B 9/10

[52] U.S. Cl. ..... 165/112; 165/111; 165/114; 261/118; 261/DIG. 32; 55/198

[58] Field of Search ..... 165/111, 112, 110, 114; 261/118, DIG. 32; 55/198, 39

[56] References Cited

U.S. PATENT DOCUMENTS 3,158,666 11/1964 Heller et al. ..... 261/118
3,391,911 7/1968 Heller et al. ..... 261/118
3,520,521 7/1970 Heller et al. ..... 261/118
3,814,398 6/1974 Bow ..... 261/115
3,834,133 9/1974 Bow ..... 261/118
3,911,067 10/1975 Chen et al. ..... 261/118

FOREIGN PATENT DOCUMENTS 101482 6/1985 Japan ..... 165/112

*Primary Examiner*—Albert W. Davis, Jr.
*Attorney, Agent, or Firm*—Beveridge, DeGrandi & Weilacher

[57] ABSTRACT

A jet condenser of the type comprising a water chamber in a mixing chamber (24) and an after-cooler (52), wherein the water chamber is subdivided in a narrower upper water chamber portion (38*a*) and a broader lower water chamber portion (39*b*). The after-cooler (52) is fixed at the junction (66) of both water chamber portions (38*a*, 38*b*). Cooling water is injected into the mixing chamber (24) by nozzles (40) of the upper water chamber portion (38*a*) where it flows in vertical direction. By the reduced width of the upper water chamber portion (38*a*) flow resistance of steam flow in the mixing chamber (24) and, thereby, undesired subcooling is substantially diminished. (FIG. 3).

17 Claims, 6 Drawing Sheets

JET CONDENSER

This invention relates to jet or direct contact condensers employed particularly with air-cooled condensation systems for condensing the exhaust steam of power station steam turbines by means of direct contact with cooling water recooled in dry cooling towers by ambient air.

In per se known jet condensers of such type the exhaust steam of the steam turbine is introduced into a mixing chamber of the condenser where it gets in direct contact with cooling water and becomes condensed. Thus, in operation, the bottom part of the mixing chamber is filled with a mixture of cooling water and condensate defining a water room of the mixing chamber. The space above the water room is left free for the flow of incoming steam and its direct contact with injected cooling water. This is the steam room part of the mixing chamber which is separated from the water room by a designed water level.

Water is injected into the steam room of the mixing chamber of the condenser in the form of water films by nozzles in the walls of a water chamber within the mixing chamber. The water chamber receives cooling water in horizontal direction from a distribution chamber having a cooling water inlet in its outer wall. In order that even distant downstream nozzles may receive suitable amounts of cooling water at required pressure the water chamber has to be of considerable cross-sectional flow area. Since the height of the condenser and, consequently, of the water chamber therein is limited, a suitable cross-sectional flow area for the horizontally inflowing cooling water may be ensured only by water chambers of considerable width which, in turn, unfavourably diminishes the cross-sectional flow area for the vertically inflowing steam in the steam room of the mixing chamber with increased steam flow velocity and collateral steam side flow resistance of the condenser. Undesirable subcooling is entailed thereby.

With jet condensers, subcooling means that the temperature of warmed up cooling water does not reach the saturation temperature associated with the pressure of the inflowing exhaust steam. Consequently, at a given condensation temperature, the temperature difference between cooling water and ambient air decreases because a relatively colder return water traverses the cooling tower of the system. Therefore, a suitable dissipation of heat would require a bigger and, thus, more expensive cooling tower to prevent an increase of the condensation temperature and ensure an undiminished output of the steam turbine.

Another undesirable effect of increased steam flow velocity is that the water films created by the injection nozzles are liable to be torn up. Torn up water films mean reduced heat transfer surfaces and, thereby, a less effective heat transfer between steam and water with an unfavourable result of subcooling.

Since, as is known, vacuum prevails in the lower stages of the steam turbine and in the condenser, due to inevitable leakages, also air will be present in the steam room of the mixing chamber. Since air does not condense, during operation its mixture with steam will ever be more enriched in air. Such increasing air content is liable to impair the heat transfer between steam and cooling water. In order to limit the air concentration growth in the steam room, the mixture of air and steam is exhausted on reaching a certain concentration value.

The mixture is conducted into an after-cooler placed beneath the water chamber in the steam room of the mixing chamber.

In the after-cooler a mixture of steam and air is entered through a gaseous fluid inlet and flows upwardly in countercurrent with cooling water exiting downwardly from the water chamber and descending between drip trays. While steam is progressively condensed, air becomes accumulated. At a certain value of air concentration the mixture rich in air is exhausted from the after-cooler while condensate mixed with cooling water drops therefrom into the water room of the mixing camber.

Since in the after-cooler the air content of the mixture of steam and air is greater than elsewhere in the condenser, partial pressure and, therewith, saturation temperature of the steam is relatively smaller. Consequently, the temperature of water leaving the after-cooler is lower than that of the warmed up cooling water in the water room of the mixing chamber. Thus, mixing of colder water from the after-cooler with warmer water in the water room of the mixing chamber entails a decrease of the average warmed up cooling water temperature with the consequence of further subcooling and the undesired result thereof mentioned hereinbefore.

It will be seen that such manifold subcoolings are unfavourably collateral to the operation of jet condensers especially of air-cooled condensing plants of power stations and should be eliminated or possibly reduced which is the main object of the present invention.

As has been shown, the steam side flow resistance, the main cause of subcooling, is dependent on the width of the water chamber which is considerable in order to ensure suitable cross-sectional flow area for the horizontally inflowing cooling water. However, if the cooling water were conducted to the injection nozzles from below rather than sideways, a suitable cross-sectional flow area for the cooling water in the water chamber might be obtained by water chambers of considerably reduced width which will be apparent if dimensions of conventional water chambers are considered. While their height is at most 1 to 1.5 meters, their length will amount to 6 to 8 meters. The cross-sectional flow area of water chambers with horizontal inflow of cooling water is determined by the product of width and height of the water chamber. On the other hand, with vertical flow it would be determined by the product of the width and the length rather than height of the water chamber at the same height of the latter which would be obviously a multiple of the conventional value. Thus, the cross-sectional flow area for an ascending cooling water would be essentially greater than with conventional water chambers with horizontal flow even if its width were significantly narrower than with known devices. Thus, at a given basic area, the cross-sectional flow area of the descending steam in the mixing chamber of the condenser might be increased and, thereby, the main cause of subcooling, namely the steam flow velocity significantly diminished if the water film nozzles were supplied with vertically ascending rather than horizontally flowing cooling water.

At the same time, the length of water films exiting from the nozzles and, thus, their surface areas would likewise be increased which means a further reduction of subcooling.

It will now be seen that the key idea of the present invention consists in changing the flow direction of the cooling water in the water chambers of jet condensers from the horizontal to the vertical. This may be obtained by water chambers which have a narrower upper water chamber portion with water film nozzles, and a broader lower water chamber portion which communicates with the cooling water inlet and serves for supplying the upper water chamber portion with ascending cooling water.

The after-cooler which, with conventional devices, lies beneath an undivided water chamber, will be located where both water chamber portions meet.

In operation, the upper water chamber portion lies in the steam room of the mixing chamber while the lower water chamber portion is substantially submerged in water collected in the water room thereof. The level of water in the water room has to be designed so as to keep the gaseous fluid inlet of the after-cooler free from being blocked by water, likewise as with after-coolers of the state of the art.

In view of what has been explained above it will now be apparent that the invention is concerned with jet condensers of the type comprising a water chamber connected to a cooling water inlet, nozzles in the walls of the water chamber for injecting cooling water from the water chamber into a mixing chamber of the condenser in the form of water films and an after-cooler. The invention proper consists in that the water chamber is subdivided into a narrower upper water chamber portion and a broader lower water chamber portion, the nozzles open from the upper water chamber portion into the mixing chamber, and the lower water chamber portion communicates with the cooling water inlet, while the after-cooler occupies a position at the junction of both said water chamber portions.

As has been explained, such arrangement has, in addition to relatively increased water film surfaces, the favourable result of an essentially reduced subcooling with respect to conventional jet condensers of the same basic area.

Subdivided water chambers with symmetrical design where the broader lower water chamber portion and the narrower upper water chamber portion have a common or nearly common plane of symmetry, both sides of the upper water chamber portion may be exploited for the purposes of after-cooling. Then, the after-cooler will be divided in two parts located each above the lower water chamber portion on another side of the upper water chamber portion. It means an increased performance of after-cooling.

In spite of the after-cooler being located at the junction of the two water chamber portions it may comprise, in a manner known per se, on the one hand, a gaseous fluid inlet communicating with a steam room of the mixing chamber of the condenser to receive a mixture of steam and air and, on the other hand, a deaerating outlet for the withdrawal of such mixture enriched in air, and heat exchange means between the two as is the case with after-coolers of known devices. It means that the after-cooler may be designed also in a conventional manner.

Then, the heat exchange means of the after-cooler will be formed as a direct contact heat exchanger where descending cooling water exiting from water supply nozzles in the wall of the upper water chamber portion flows in flow passages confined by drip trays downstream of the water supply nozzles between the gaseous fluid inlet and the deaerating outlet. Thus, such arrangement means nearly conventional design and customary operation.

Subcooling due to mixing of colder cooling water withdrawing from the after-cooler with the bulk of cooling water in the water room of the mixing chamber may be decreased by preventing such water to flow directly into the water room. For such purpose a water collecting tray may be provided beneath the lowermost of the drip trays of the after-cooler with a water discharge passage. This permits to increase the amount of cooling water introduced into the after cooler and, thereby, the amount of the mixture of steam and air as well. Then, air concentration at the bottom of the steam room that is near the designed water level in the mixing chamber will be relatively smaller with a corresponding decrease of subcooling.

Water collected in the water collecting tray will be resupplied through the discharge passage into the lower water chamber portion or into the steam room of the mixing chamber.

In the first case, the water discharge passage will be connected through a pump to the lower water chamber portion.

In the second case, it will be connected likewise through a pump and, in addition, through a nozzle to the mixing chamber of the condenser above the designed water level that is into the steam room. In neither case has the water withdrawing from the after-cooler direct access to the water room of the mixing chamber and, thus, subcooling due to direct intermixing is avoided.

However, the heat exchange means of the after-cooler may consist in a surface heat exchanger as well with heat transfer surfaces adapted to be cooled by cooling water in the water chamber portions. This permits to connect the heat exchange means of the after-cooler on the water side in series with other parts of the condenser and, thereby, to employ the principle of countercurrent flow. The whole amount of cooling water may then be conducted in countercurrent with the mixture of steam and air through the after-cooler whereby losses caused by mixing of colder cooling water from the after-cooler with the bulk of warmer water in the water room of the mixing chamber will be eliminated and subcooling further diminished.

Preferably, the heat transfer surfaces of the surface heat exchanger on its steam side will be extended by cooling ribs attached to the lower water chamber portion with a corresponding increase of performance. Condensate in flow passages on the steam side of the surface heat exchanger flows down into the water room of the mixing chamber. Its amount is about fifty times smaller than that of the water flowing in the after-cooler with direct contact heat exchange means and less than one per thousand of the whole amount of cooling water. Thus, practically, no subcooling will be entailed which is the main advantage of employing surface type heat exchange means.

In order to save precious water of condensate quality, a drip separator may be provided in an air exhaustor passage connected to the deaerating outlet of the after-cooler. Then, condensate will collect in the drip separator rather than be discharged together with air and may be resupplied into the cooling water system.

For such purpose a water outlet of the drip separator may be connected through a pump either directly to the lower water chamber portion or, through an additional nozzle, to the mixing chamber of the condenser. Obviously, the nozzle has to be placed above the designed water level. In either case the bulk of cooling water in the water room of the mixing chamber will be relieved from directly admixed colder water with a corresponding decrease of subcooling. In cases where the drip separator in the air exhaustor passage is placed suitably high, the pump can be omitted.

It is possible to form the heat exchange means of the after-cooler as a combination of a surface heat exchanger and a direct contact heat exchanger. Such combination may be preferable if, for instance, performance of the aftercooler has to be increased.

A simple structure can be arrived at if, in the combination, the direct contact heat exchanger is arranged on top of the surface heat exchanger which, in turn, is directly above the lower water chamber portion. Both heat exchangers have common flow passages which are confined, on the one hand, by drip trays of the direct contact heat exchanger and, on the other hand, by the lower water chamber portion and by an outer wall of the surface heat exchanger between the gaseous fluid inlet and the deaerating outlet. Thus, a mixture of steam and air is first exchanging heat with cooling water flowing in the water chamber portions and, thereafter, by direct contact with cooling water in the direct contact heat exchanger.

The heat transfer passages of the surface heat exchanger may be provided with cooling ribs attached to the lower water chamber portion which is beneficial to its performance as mentioned above in connection with after-coolers having but surface heat exchange means.

The basic expedient of the invention, namely the subdivision of the water chamber in a broader lower water chamber portion and a narrower upper water chamber portion, may have special significance with air-cooled condensation systems where cooling water is circulated by two parallel aggregates consisting each of a pump unit and a water turbine unit on a common axle which carries an electric motor destined to cover output differences between the former. The two aggregates with 50 % capacity each are reserves of one another. If one of the aggregates drops out, water is supplied to the condenser only by the water turbine of the other aggregate in which case the delivered amount of cooling water is about the half of total delivery. Then, nozzles of the water chamber of conventional devices fail to operate properly so that water films of reduced surface area are formed and subcooling increased.

In order to obviate such deficiency it has been suggested to subdivide the water chamber of the condenser in two parts by a horizontal partition and to provide each part with half of the total number of nozzles each group of which being supplied with cooling water from another aggregate. Then, in case of partial drop-out operating nozzles still receive suitable amounts of water and the condenser operates properly though with reduced performance.

A further advantage of such solution consists in that the resistance of the nozzles does not decrease so that a working water turbine unit or a throttle valve substituting the same will operate nearly as designed. Thus, possible danger of cavitation is more reliably avoided than with devices having undivided water chambers.

However, subdivision of the water chamber makes it inevitable that at drop-out of one of the aggregates cooling water in the respective part of the water chamber will be drained through its nozzles into the mixing chamber of the condenser. Thereby, the level of water may rise beyond the designed water level and the gaseous fluid inlet of the after-cooler may become blocked by water. Consequently, pressure in the condenser would quickly increase and may trigger the protective system of the associated steam turbine which, in turn, may entail a drop-out of a corresponding part of the power plant.

Nevertheless, such otherwise advantageous subdivision of the water chamber may be carried out with condensers according to the invention under substantially more favourable conditions which is due to the reduced width of the upper water chamber portion from which water may be drained since all nozzles are located there. By draining the upper water chamber portion of reduced width and, consequently, of relatively smaller volume the water level in the mixing chamber of the condenser will be raised significantly less than with known devices having water chambers of considerable width and a correspondingly bigger volume. Thus, flooding of the after-cooler inlet and, therewith, drop-out of power plant units will practically be avoided without any significant increase of subcooling.

In view of the explanations given above, with the condenser according to the invention, both the lower water chamber portion and the upper water chamber portion may be subdivided each in a pair of water chamber subportions. The subportions of the lower water chamber portion will have individual cooling water inlets while groups of nozzles will open each from another subportion of the upper water chamber portion into the mixing chamber of the condenser.

Hereinafter, the invention will be described in closer details by taking reference to the accompanying drawing the sheets of which show various exemplified embodiments of the invention in comparison with the type of known devices of similar destination. In the drawing.

Like reference numerals refer to similar details throughout the drawing.

Figure 1:
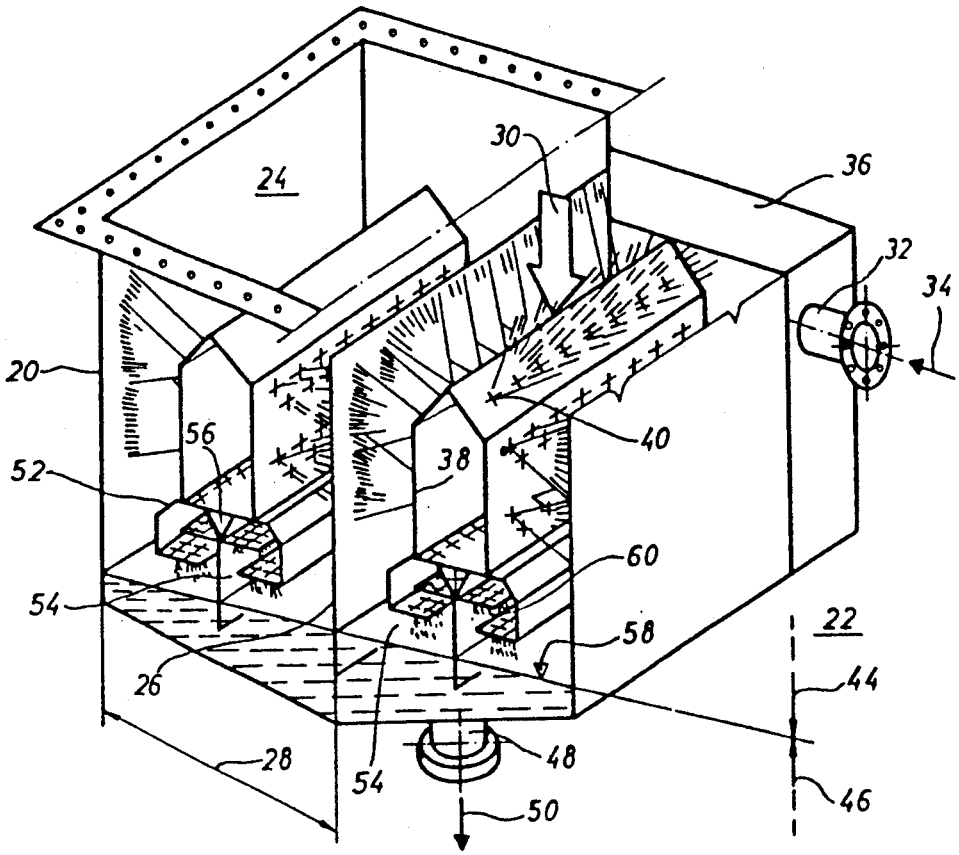
PRIOR ART FIG. 1
FIG. 1 is a perspective view of a conventional jet condenser partly in section.

In FIG. 1 there is a conventional jet condenser for air-cooled condensation cooling systems such as disclosed e.g. in the specification of U.S. Pat. No. 3,520,521 to Heller et al.

Figure 2:
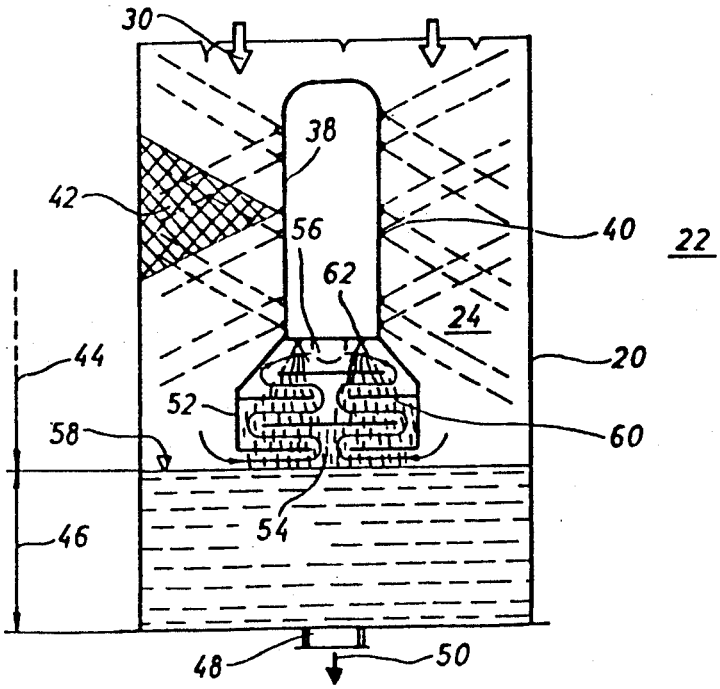
PRIOR ART FIG. 2
FIG. 2 shows a sectional view of a device similar to that illustrated in FIG. 1.

A shell 20 of the condenser, generally referred to by reference numeral 22, encloses a mixing chamber 24. Vertical partitions 26 subdivide the mixing chamber 24 into sections 28 the number of which may be more than illustrated or the partitions may be dispensed with at all as illustrated in FIG. 2.

Through an inlet, not shown, exhaust steam of a steam turbine, associated with the condenser, enters the mixing chamber 24 from above as suggested by arrows 30 where it becomes condensed by direct contact with cooling water. Such water is introduced into the condenser 22 through an inlet 32 in direction of arrow 34. It flows into a distribution chamber 36 and from there in horizontal direction into water chambers 38. The walls of the water chambers 38 are provided with nozzles 40 through which the horizontally inflowing cooling water is injected in the form of vertical water films 42 into the mixing chamber 24 of the condenser 22. One of the injected water films 42 is suggested by cross-ruling in FIG. 2.

Incoming steam and injected cooling water intermix in direct contact in a steam room 44 in the top part of the mixing chamber 24 due to which steam becomes condensed. The mixture of condensate and cooling water falls down into a water room 46 at the bottom of the mixing chamber 24 and withdraws therefrom through an outlet 48 as suggested by arrow 50.

For reasons explained hereinbefore the condenser 22 is provided with an after-cooler 52 which, with known devices, is arranged beneath the water chamber 38. The after-cooler 52 has a gaseous fluid inlet 54 for receiving and a deaerating outlet 56 for the withdrawal of a mixture of steam and air, respectively. Obviously, as has already been mentioned, level 58 of water in the water room 46 has to be designed so that, in operation of the condenser 22, a mixture of steam and air always has access to the inlet 54 which must not be blocked by cooling water in the mixing chamber 24.

Between the gaseous fluid inlet 54 and the deaerating outlet 56 there are drip trays 60 upstream which there are nozzles 62 from which cooling water is supplied to the drip trays 60.

In operation, on the one hand, exhaust steam enters the mixing chamber 24 in direction of arrows 30. On the other hand, cooling water is introduced in direction of arrow 34 through inlet 32 into the distribution chamber 36 from which it flows horizontally into the water chamber or chambers 38, and is injected from there by the nozzles 40 in the form of water films 42 into the steam room 44 of the mixing chamber 24. There, steam gets in direct contact with water films 42 of cooling water on the surfaces of which its main body becomes condensed.

Condensate created in the steam room 44 drops down into the water room 46 of the mixing chamber 24 while a fractional part of steam together with uncondensing air enters the after-cooler 52 through the gaseous fluid inlet 54.

Cooling water collected in the water room 46 is reentered into the cooling system through the outlet 48 in direction of arrow 50 while the remaining mixture of steam and air entering the aftercooler 52 ascend in countercurrent with cooling water dropping down to subsequent drip trays 60. In the course of direct contacting of the ascending mixture and descending cooling water greater part of the steam in the mixture condenses while the mixture itself becomes enriched in air. Condensate drops, together with cooling water, into the water room 46 beneath the after-cooler 52 while a mixture of still uncondensed steam and air exits through outlet 56 thereby relieving the steam room 44 from an air content liable to impair a desired heat transfer between steam and water.

It will be seen that the water chambers 38 of devices of the state of the art occupy considerable cross-sectional flow area as regards steam flow (arrow 30) which entails, as has been explained, an increased subcooling because of higher steam side flow resistance.

Figure 3:
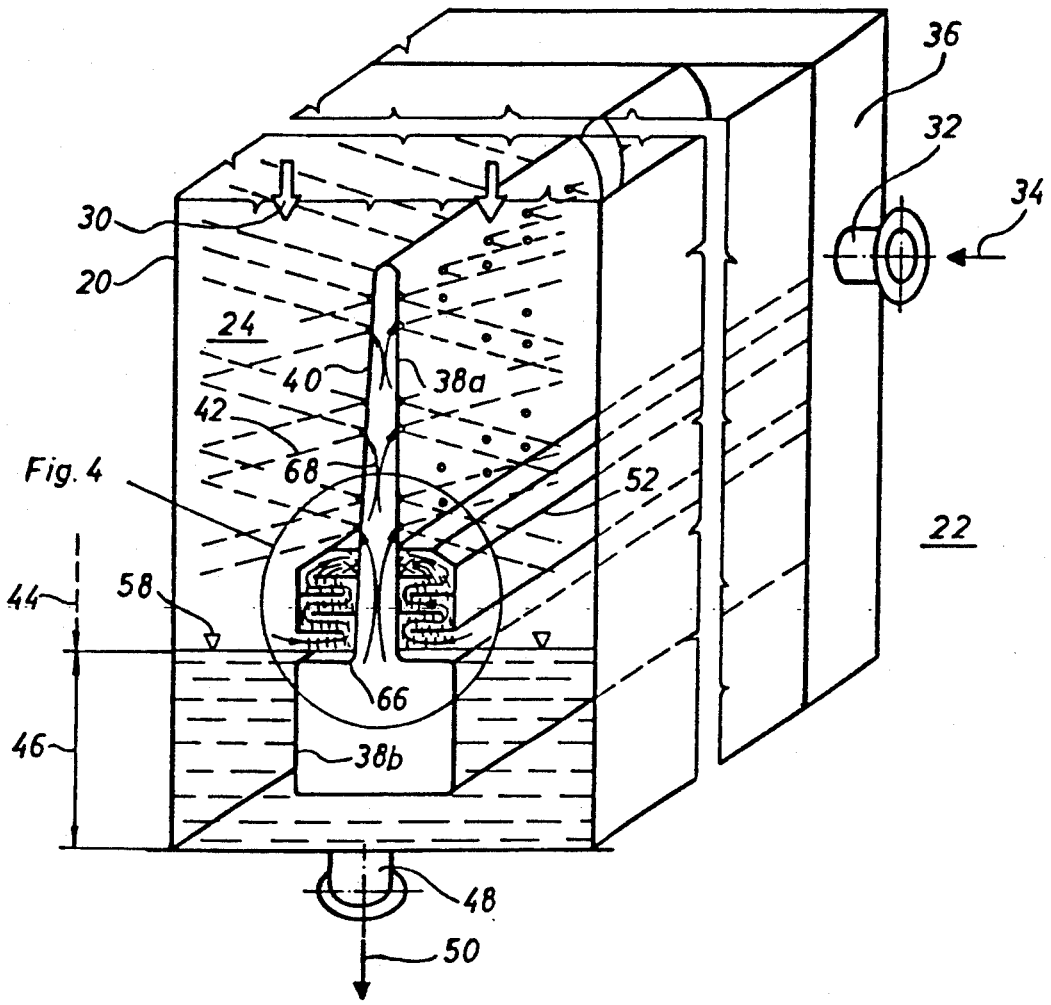
FIG. 3 represents a perspective view of an exemplified embodiment of the invention.
Figure 4:
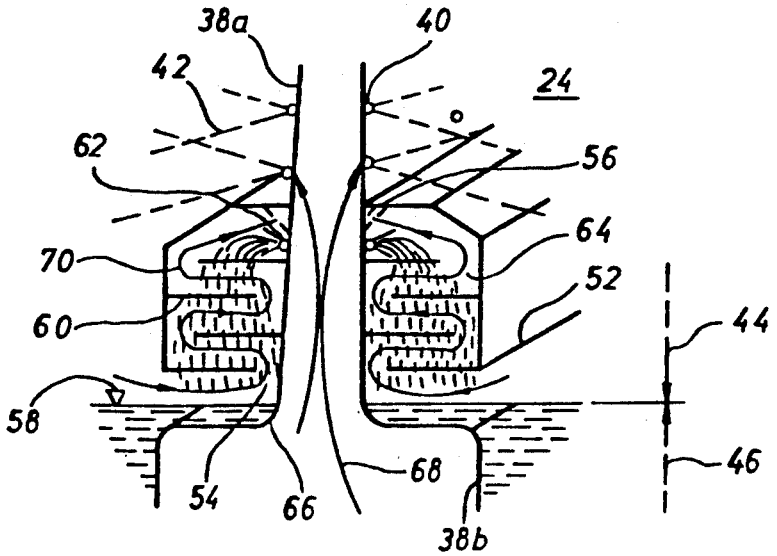
FIG. 4 illustrates a detail of FIG. 3 on an enlarged scale.

As shown in FIGS. 3 and 4, such deficiency is, in compliance with the main feature of the invention, eliminated by subdividing the water chamber 38 into a narrower upper water chamber portion **38*a* and a broader lower water chamber portion 38*b*. The two water chamber portions 38*a* and 38*b* meet at a junction 66 through which cooling water from the lower water chamber portion 38*b* may enter the upper water chamber portion 38*a*. Nozzles 40 which inject cooling water into the mixing chamber 24 open from the upper water chamber portion 38*a* while the lower water chamber portion 38*b* communicates with the distribution chamber 36** through an orifice, not shown.

Since the lower water chamber portion **38*b* is, partly or wholly, submerged in the water room 46 of the mixing chamber 24, an aftercooler 52 obviously cannot be placed beneath the water chamber 38 as in case of known devices. Therefore, in compliance with a further main feature of the invention, it occupies a position at the junction 66 of the two water chamber portions 38*a* and 38*b* for which purpose subdivision of the water chamber 38 clearly offers an advantageous possibility. Viz., due to a difference between the widths of the water chamber portions 38*a* and 38*b*, room is left free for placing the after-cooler 52 at the side of the upper water chamber portion 38*a***.

As has been explained, if the two water chamber portions **38*a* and 38*b* have a common or nearly common plane of symmetry, as in the instant case, both sides of the upper water chamber portion 38*a* are at disposal for fixing after-cooler 52. Then, the after-cooler 52 is, as it were, cut through and, thereby, subdivided in two parts located each above the lower water chamber portion 38*b* on another side of the upper water chamber portion 38*a*** as illustrated in the drawing.

Otherwise, as in the instant case, the after-cooler 52 may be of conventional design having, on the one hand, a gaseous fluid inlet 54 communicating with the steam room 44 of the mixing chamber 24 and, on the other hand, a deaerating outlet 56, heat exchange means being provided between the two.

With the represented embodiment, the heat exchange means is formed, in a manner known per se, as a direct contact heat exchanger comprising drip trays 60 which are supplied with cooling water from water supply nozzles 62 in the walls of the upper water chamber portion **38*a*. The drip trays 60 confine flow passages 64 which communicate with the gaseous fluid inlet 54 and the deaerating outlet 56 of the after-cooler 52**.

In operation, exhaust steam flows in direction of arrow 30 into the mixing chamber 24 as was the case with the known devices shown in Figs. 1 and 2. However, the paramount difference with respect to the state of the art consists in that the flow of cooling water which fills the lower water chamber portion **38*b* is turned from the horizontal to the vertical at the junction 66 of the water chamber portions 38*a* and 38*b* so that it flows upwardly in the upper water chamber portion 38*a* as indicated by arrows 68** and, thus, has a cross-sectional flow area which is a multiple with respect to conventionally designed water chambers with all the favourable results explained in detail in the opening part of the specification.

While the bulk of inflowing exhaust steam becomes condensed in the steam room 44 and its condensate collects in the water room 46 of the mixing chamber 24, a subordinate part of it mixed with air flows from the steam room 44 through the inlet 54 into the direct contact heat exchanger 54, 60, 62, 64 in the after-cooler 52 as indicated by arrows 70 where it meets cooling water dropping down in the flow passage 64 on subsequent drip trays 60. The steam progressively condenses and, thus, the ascending mixture becomes increasingly enriched with air so that, eventually, a mixture rich in air will withdraw through the deaerating outlet 56. Condensed steam exits, together with the down flowing cooling water, into the water room 46 of the mixing chamber 24 where it intermixes with the bulk of water there.

Figure 5:
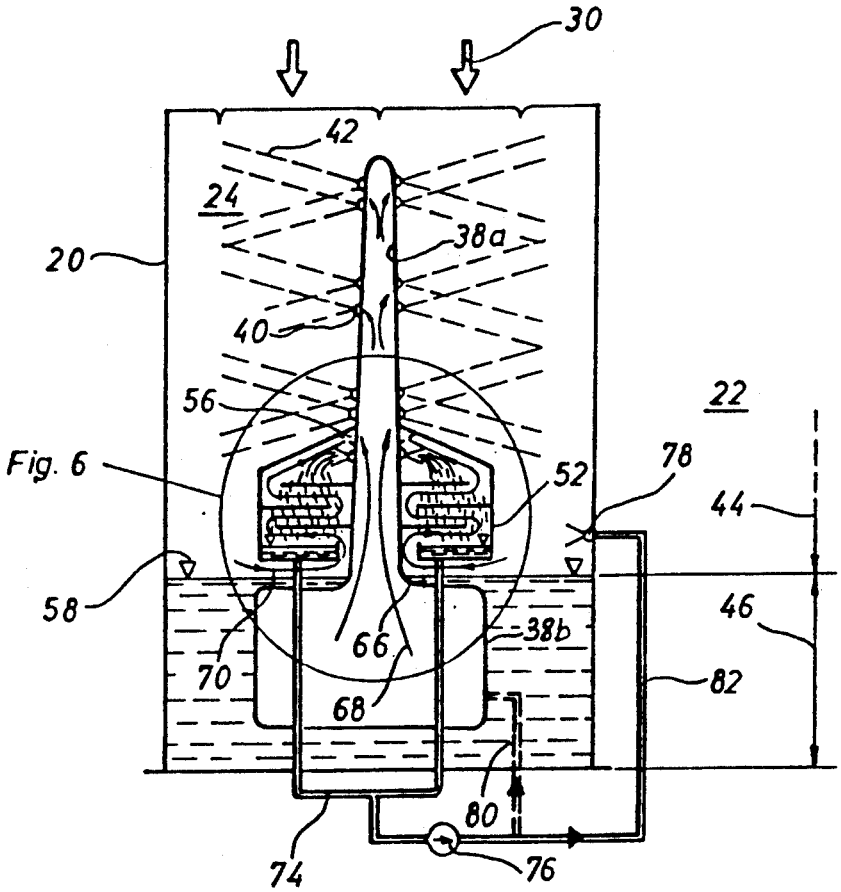
FIG. 5 is a sectional view of another exemplified embodiment of the invention.
Figure 6:
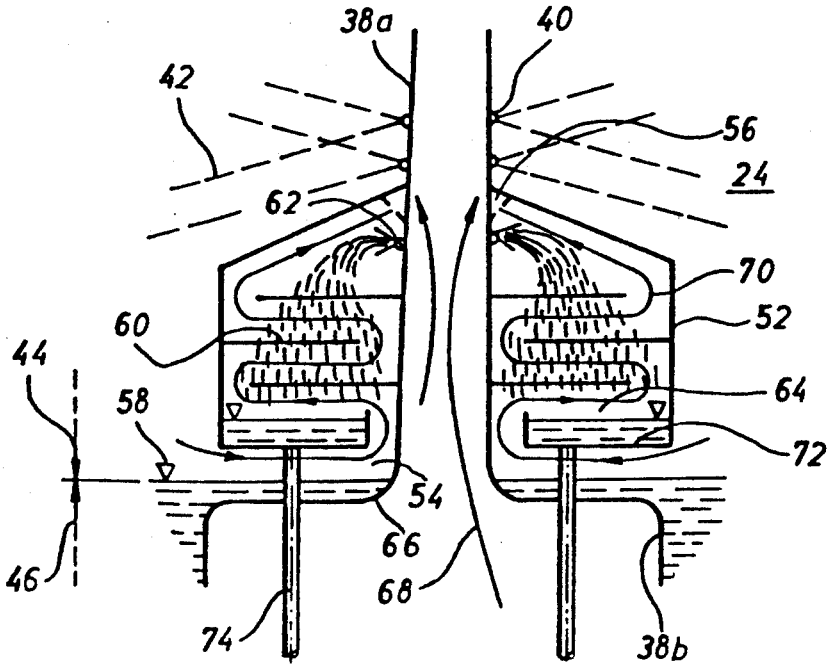
FIG. 6 shows a detail of FIG. 5 on an enlarged scale.

The exemplified embodiment of the invention illustrated in FIGS. 5 and 6 without showing irrelevant parts differs from the previously described one in that the mixture of cooling water and condensate descending in the flow passages 64 in the after-cooler 52 is prevented from flowing directly into the water room 46 of the mixing chamber 24. Thereby, subcooling caused by intermixing of colder water exiting from the after-cooler 52 and water warmed up in the steam room 44 to a higher temperature may be avoided as has been explained.

For such purpose, a water collecting tray is provided beneath the lowermost drip tray 60 of the direct contact heat exchanger 54, 60, 62, 64. The water collecting tray 72 has a water discharge passage 74 connected to it. The water discharge passage 74 comprises a pump 76 by which the water collected in the water collecting tray 72 may be delivered either into the water chamber **38*a*, 38*b* or, through a nozzle 78, into the steam room 44 of the mixing chamber 24 as suggested by broken and full lines 80 and 82, respectively, in FIG. 5. In either case water drained from the water collecting tray 72 bypasses the water room 46 and gets back into the steam room 44 of the mixing chamber 24. There, it is warmed up the inflowing exhaust steam to the temperature of the water collected in the water room 46** without entailing subcooling.

Otherwise, operation is as described in connection with FIGS. 3 and 4.

As has been mentioned, subdivision of the water chamber 38 of known devices permits to form the after-cooler 52 as a surface heat exchanger similar to the after-coolers of surface condensers. Then, the whole amount of cooling water rather than but a portion thereof may be conducted through the after-cooler 52 so that mixing of colder cooling water from the after-cooler 52 with warmer condensate from the steam room 44 of the mixing chamber 24 will be avoided and, thereby, subcooling further decreased.

Figure 7:
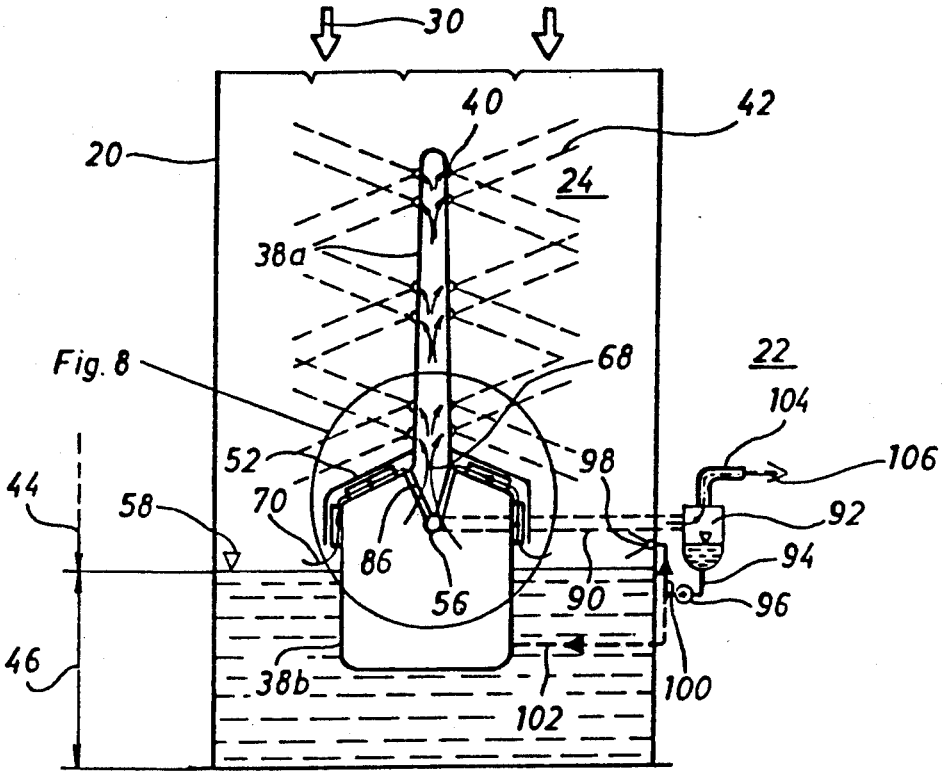
FIG. 7 represents, by way of example, a sectional view of still another embodiment of the invention.
Figure 8:
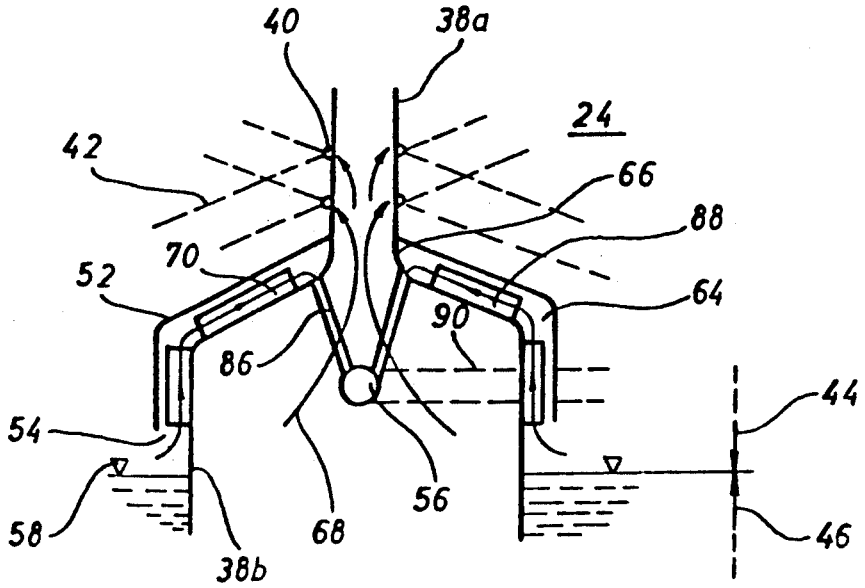
FIG. 8 illustrates a detail of FIG. 7 on an enlarged scale.

FIGS. 7 and 8 show, without illustrating irrelevant details, an exemplified embodiment of the invention with such after-cooler 52. Its flow passages 64 communicate through the gaseous fluid inlet 54 above the designed water level 58 with the steam room 44 of the mixing chamber 24 as was the case with the previously described embodiments. However, at the junction 66 of the water chamber portions **38*a* and 38*b* there are conduits 86 which connect the flow passages 64 with the deaerating outlet 56. Heat transfer surfaces of the surface heat exchanger are the walls of the lower water chamber portion 38*b*** and are cooled by cooling water flowing therein.

Moreover, in the instant case, the heat transfer surfaces of the after-cooler 52 are extended by cooling ribs 88 attached to the lower water chamber portion **38*b*** e.g. by means of welding thereby increasing the heat transfer surfaces.

Likewise in the instant case, the deaerating outlet 56 of the after-cooler 52 has an air exhaustor passage 90 connected to it which comprises a drip separator 92 and leads to a vacuum pump, not shown.

Furthermore, with the represented embodiment, the drip separator 92 has a water outlet 94 which is connected through a pump 96 and a nozzle 98 to the steam room 44 of the mixing chamber 24 or to the lower water chamber portion **38*b* as suggested by full and broken lines 100 and 102, respectively. Reference numeral 104 designates an air outlet of the drip separator 92**.

In operation, cooling water in the water chamber portions **38*a*, 38*b* and a mixture of steam and air in the after-cooler 52 flow as suggested by arrows 68 and 70, respectively. While the entire amount of cooling water is conducted through the water chamber portions 38*a*, 38*b*, only a fractional part of uncondensed steam and the whole amount of air flow from the steam room 44 into the after-cooler 52. Due to heat transfer across the walls of the lower water chamber portion 38*b* steam in the mixture flowing in the after-cooler 52** progressively condenses.

Condensate of such steam the amount of which is, as has been stated, a negligible part of the total amount of cooling water, flows back through the flow passages 64 into the water room 46 of the mixing chamber 24. In view of the smallness of its amount its intermixing with the warm water in the water room 46 does not entail any significant subcooling.

The rest of uncondensed steam and air withdraws from the after-cooler 52 through the deaerating outlet 56 and the air exhaustor passage 90 while some additional condensation takes place. Condensate of residual steam will collect in the drip separator 92 and may be resupplied onto the system by the pump 96 without directly interfering with the warm water in the water room 46. Thus, on the one hand, no subcooling is caused and, on the other hand, precious water of condensate quality is saved.

Air leaves the drop separator 92 through its air outlet 104 as suggested by arrow 106.

Figure 9:
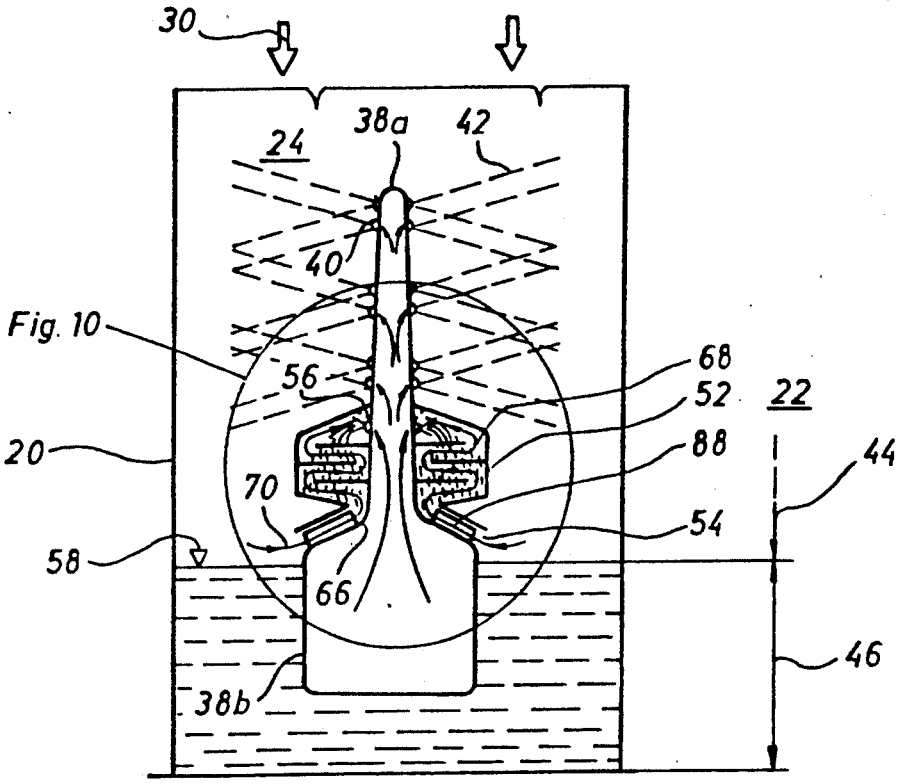
FIG. 9 is a sectional view of a further exemplified embodiment of the invention.
Figure 10:
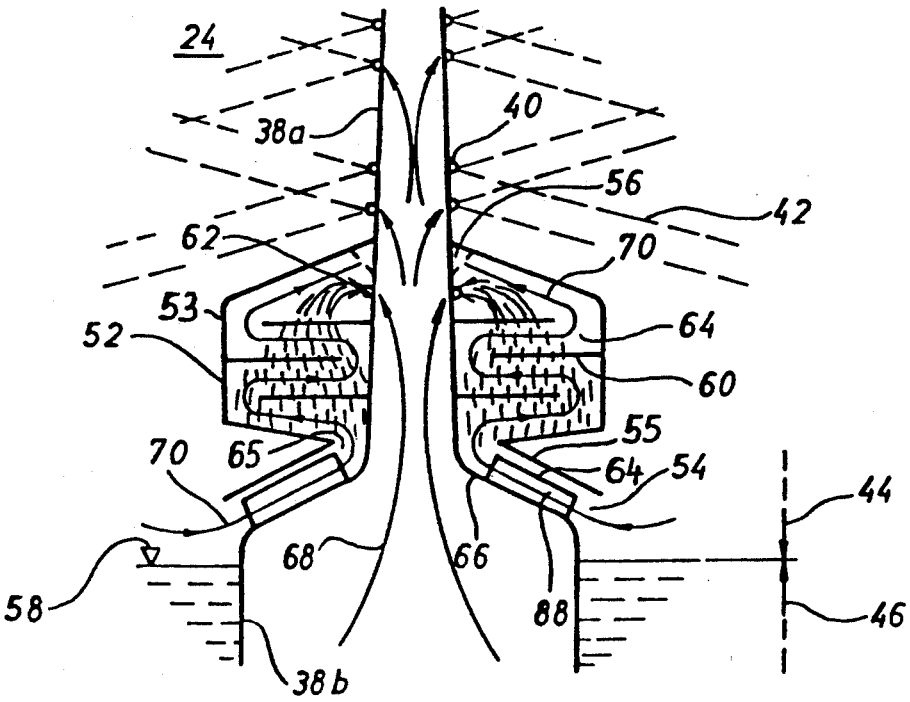
FIG. 10 shows a detail of FIG. 9 on an enlarged scale.

As was mentioned hereinbefore, the after-cooler 52 may consist in a combination of a surface heat exchanger and a direct contact heat exchanger as shown in FIGS. 9 and 10.

In the instant case, the direct contact heat exchanger is arranged on top of the surface heat exchanger which, in turn, lies directly above the lower water chamber portion **38*b*. Their flow passages 64 are interconnected through a gap 65 at the meeting of the outer walls 53 and 55 of the direct contact heat exchanger and the surface heat exchanger, respectively. Thus, in the instant case, the surface heat exchanger may be referred to by reference numerals 38*b*, 54, 55, 64, 65 while the direct contact heat exchanger may be designated by reference numerals 53, 56, 60, 62, 64, 65**.

In operation, a mixture of steam and air from the steam room 44 of the mixing chamber 24 enters the flow passages 64 of the surface heat exchanger **38*b*, 54, 55, 64, 65 through the gaseous fluid inlet 54 as indicated by arrows 70. It becomes cooled by cooling water ascending from the lower water chamber portion 38***b* into the upper water chamber portion 38*a* as indicated by arrows 68. At the gap 65 the inflowing mixture enters the flow passages 64 of the direct contact heat exchanger 53, 56, 60, 62, 64, 65 where it meets, in countercurrent, cooling water introduced through water supply nozzles 62 and dripping down on subsequent drip trays 60. Withdrawal, on the one hand, of residual steam and air and, on the other hand, of condensate takes place as was described in connection with the embodiments illustrated in FIGS. 3 and 4 and in FIGS. 7 and 8, respectively.

The combination as described above is distinguished, on the one hand, by increasing the capacity of the after-cooler 52 by its direct contact heat exchanger 53, 56, 60, 62, 64, 65 and, on the other hand, by decreasing subcooling by means of its surface heat exchanger 38*b*, 54, 55, 64, 65.

Figure 11:
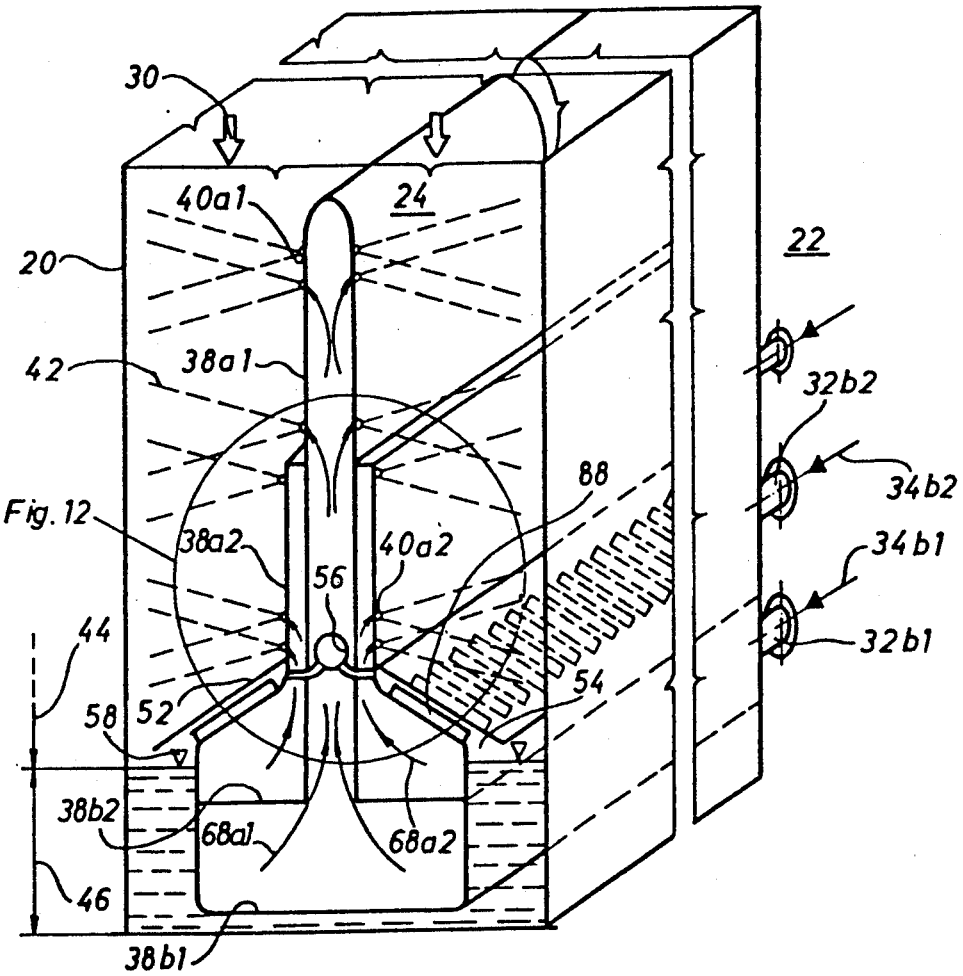
FIG. 11 represents a perspective view of a still further exemplified embodiment of the invention. Finally.
Figure 12:
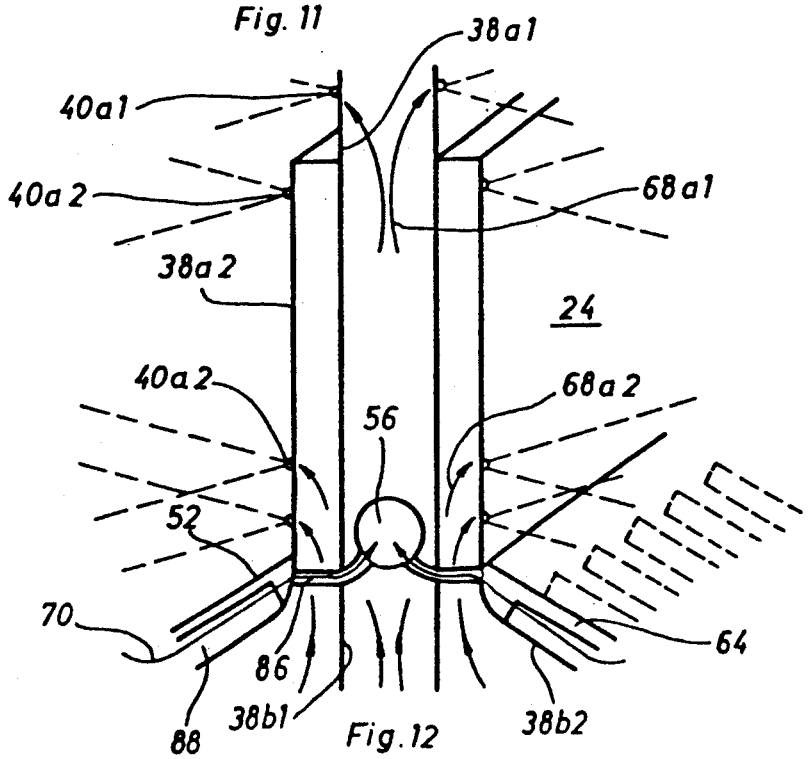
FIG. 12 illustrates a detail of FIG. 11 on an enlarged scale.

FIGS. 11 and 12 illustrate relevant parts of an embodiment of the invention where both water chamber portions 38*a* and 38*b* are subdivided each in a pair of water chamber subportions 38*a*1 and 38*a*2 as well as 38*b*1 and 38*b*2, respectively. Subportions 38*b*1 and 38*b*2 of the lower water chamber portion 38*b* have individual cooling water inlets 32*b*1 and 32*b*2, respectively which may be connected each to one of a pair of cooperating delivery units (water turbines), not shown, as was explained in the introduction of the specification.

Water film nozzles 40 of the condenser are distributed between two groups each of which is associated with another subportion 38*a*1 and 38*a*2 of the upper water chamber portion 38*a* from which they open into the steam room 44 of the mixing chamber 24. One nozzle of each group is designated by reference numerals 40*a*1 and 40*a*2, respectively, in the drawing. Preferably, both groups will have the same number of nozzles.

In operation, cooling water is introduced through the inlets 32*b*1 and 32*b*2 into the water chamber subportions 38*b*1 and 38*b*2 of the lower water chamber portion 38*b* from another delivery unit of the aggregate as indicated by arrows 34*b*1 and 34*b*2, respectively. Cooling water flows up from the lower water chamber subportions 38*b*1 and 38*b*2 into the subportions 38*a*1 and 38*a*2 of the upper water chamber portion 38*a* as suggested by arrows 68*a*1 and 68*a*2, respectively.

In normal operation where both aggregates are properly working, both water chamber subportions 38*a*1 and 38*a*2 receive suitable amounts of cooling water for both groups of nozzles 40*a*1 and 40*a*2, respectively.

If one of the aggregates drops out, water supply in the respective water chamber subportion 38*a*1, 38*a*2 of the upper water chamber portion 38*a* ceases. While cooling water from the water chamber subportion 38*a*1 or 38*a*2 left without water supply is drained through its water film nozzles 40*a*1 or 40*a*2 into the water room 46 of the mixing chamber 24, as the case may be, water film nozzles of the other water chamber subportion continue to be provided with cooling water of suitable amount and pressure so that they operate as required. Due to relatively reduced width of the upper water chamber portion 38*a*, drainage of the water chamber subportion left without water supply entails obviously much less rise of the designed water level 58 than the drainage of water chambers of known devices even if they are subdivided as mentioned above.

As a favourable result, neither flooding the inlet 54 nor a drop out of a power plant unit is liable to occur.

As it was explained hereinbefore, the invention has various improvements over the prior art in the control of subcooling even with side effects of operational nature. They are all due to the simple expedient of turning the flow direction of cooling water which supplies the water film nozzles of a water chamber of a jet condenser from the horizontal to the vertical.

We claim:

1. A jet condenser, comprising: a shell defining a mixing chamber adapted to receive exhaust steam, a water chamber in the mixing chamber, said water chamber subdivided into a narrower upper water chamber portion and a broader lower water chamber portion, a cooling water inlet connected to said lower water chamber portion, nozzles in said upper water chamber portion for injecting cooling water into said mixing chamber in the form of water films, a cooling water outlet at a bottom portion of said mixing chamber, and an after-cooler positioned at a junction of said upper and lower water chamber portions.

2. The condenser as claimed in claim 1, wherein said after-cooler is subdivided into two parts, each of said parts located above said lower water chamber portion, and a first part of said after-cooler located on one side of said upper water chamber portion, and a second part of said after-cooler located on another side of said upper water chamber portion.

3. The condenser as claimed in claim 1, wherein said after-cooler includes a gaseous fluid inlet communicating with said mixing chamber to receive a mixture of steam and air therefrom, a deaerating outlet for withdrawal of said mixture enriched in air, and a heat exchange means between said gaseous fluid inlet and said deaerating outlet.

4. The condenser as claimed in claim 3, wherein said heat exchange means of said after-cooler is in the form of a direct contact heat exchanger.

5. The condenser as claimed in claim 4, wherein said direct contact heat exchanger in said after-cooler includes water supply nozzles in a wall of said upper water chamber portion, drip trays downstream of said water supply nozzles, and flow passages defined by said drip trays between said gaseous fluid inlet and said deaerating outlet.

6. The condenser as claimed in claim 5, further comprising a water collecting tray located beneath a lowermost of said drip trays and a water discharge passage connected to said water collecting tray.

7. The condenser as claimed in claim 6, further comprising a pump in said water discharge passage, said water discharge passage connecting said water collecting tray with said lower water chamber portion.

8. The condenser as claimed in claim 6, further comprising a pump in said water discharge passage, said water discharge passage connecting said water collecting tray with a nozzle in a wall of said mixing chamber.

9. The condenser as claimed in claim 3, wherein said heat exchange means of said after-cooler is in the form of a surface heat exchanger, said surface heat exchanger including flow passages having a common wall with said lower water chamber portion.

10. The condenser as claimed in claim 9, wherein said surface heat exchanger in said after-cooler further including cooling ribs in said flow passages attached to said common wall.

11. The condenser as claimed in claim 3, further comprising an air exhaustor passage connected to said deaerating outlet, and a drip separator in said air exhaustor passage.

12. The condenser as claimed in claim 11, wherein said drip separator has a water outlet connected through a pump to said lower water chamber portion.

13. The condenser as claimed in claim 11, wherein said drip separator has a water outlet connected through a pump to a nozzle in a wall of said mixing chamber.

14. The condenser as claimed in claim 3, wherein said heat exchange means of said after-cooler is in the form of a combination of a surface heat exchanger and a direct contact heat exchanger.

15. The condenser as claimed in claim 14, wherein said surface heat exchanger in said after-cooler is located above said lower water chamber portion, said direct contact heat exchanger including drip trays and is arranged above said surface heat exchanger, and both said surface heat exchanger and said direct contact heat exchanger have common flow passages between the gaseous fluid inlet and the deaerating outlet.

16. The condenser as claimed in claim 15, further comprising cooling ribs in said common flow passages attached to a wall of said lower water chamber portion.

17. The condenser as claimed in claim 1, wherein said upper and lower water chamber portions are further subdivided into a pair of upper water chamber subportions and a pair of lower water chamber subportions, the lower water chamber subportions including individual cooling water inlets, and at least one nozzle opening from each upper water chamber subportion into said mixing chamber.

* * * * *